United States Patent [19]

Marjollet et al.

[11] 4,143,619

[45] Mar. 13, 1979

[54] HEAT EXCHANGER FOR SUPERHEATING STEAM

[75] Inventors: Jacques Marjollet, Paris; Gérard Palacio, Montmorency; Gérard Tondeur, Velizy Villacoublay, all of France

[73] Assignee: Stein Industrie S.A., Velizy Villacoublay, France

[21] Appl. No.: 780,997

[22] Filed: Mar. 24, 1977

[30] Foreign Application Priority Data

Mar. 30, 1976 [FR] France ..... 76 09191

[51] Int. Cl.[2] ..... F22G 1/00; F28F 9/22

[52] U.S. Cl. ..... 122/483; 165/110; 165/161

[58] Field of Search ..... 122/483; 165/160, 161, 165/111, 78, 110

[56] References Cited

U.S. PATENT DOCUMENTS

| | | | |
|---|---|---|---|
| 2,256,882 | 9/1941 | Sebald | 165/72 |
| 2,800,307 | 7/1957 | Putney | 165/161 |
| 2,995,343 | 8/1961 | Gardner et al. | 122/483 |
| 3,199,582 | 8/1965 | Vogt et al. | 165/161 |
| 3,500,796 | 3/1970 | Rofler | 122/483 |
| 3,712,272 | 1/1973 | Carnavos | 165/78 |
| 3,713,278 | 1/1973 | Miller et al. | 122/483 |
| 3,738,305 | 6/1973 | Campbell et al. | 165/74 |
| 3,923,009 | 12/1975 | Somma | 122/483 |
| 4,016,835 | 4/1977 | Yarden et al. | 122/483 |
| 4,029,055 | 6/1977 | Haese | 122/483 |

*Primary Examiner*—Charles J. Myhre
*Assistant Examiner*—Sheldon Richter
*Attorney, Agent, or Firm*—Haseltine, Lake & Waters

[57] ABSTRACT

The heat exchanger comprises an outer cylindrical casing and an inner cylindrical sleeve coaxially mounted therein. Dry superheated steam circulates in the jacket between the outer casing and the inner sleeve, and may be extracted at any convenient point along the casing. Wet steam is introduced into the inner casing whose lower portion comprises a separation baffle for removing water from the wet steam and whose upper portion has nests of heat exchanging tubes for superheating the steam.

8 Claims, 3 Drawing Figures

HEAT EXCHANGER FOR SUPERHEATING STEAM

The present invention relates to a heat exchanger for superheating steam, in particular for a horizontal separator used to supply a high-power turbine with steam.

In known horizontal axis heat exchangers the superheated steam which is in contact with the tubes of the superheater rises in a sort of tunnel along the top generatrix of the outer casing which contains the device as a whole and is then removed through a tube in the centre of the device, towards the load which is, in this case, a steam expansion turbine. This configuration has the disadvantage of requiring a connection between the heat exchanger and the turbine by means of long elbowed tubing; this results in a degree of cooling, i.e., a useless loss of energy.

The present invention aims to reduce substantially the length of the connection pipe between the superheated steam outlet and the turbine inlet for superheated steam; to do this, the outer casing is provided with a coaxial inner sleeve which contains the separator and the nest of tubes of the superheater through which there flows the water emulsion which is to be separated from the steam to be superheated. When it has been treated, the superheated steam fills the jacket between the sleeve and the outer casing from which it can be removed at any point of its periphery and this makes it possible to choose a removal point at the shortest distance from the turbine inlet to be supplied.

The heat exchanger of the present invention comprises a cylindrical outer casing with a horizontal axis and a coaxial inner sleeve leaving an outer space in which the superheated steam flows, while the steam to be superheated flows inside the inner sleeve which includes parallel to its axis:

(a) In its lower part, a separator with baffle plates for removing the water from the emulsion of water and steam to be superheated; and (b) In its upper part, nests of tubes constituting the superheater.

Another characteristic of the invention resides in the fact that the use of stainless steel can be reduced to those parts of the device which are subjected to the corrosive action of wet steam before superheating, i.e., the interior sleeve and at the end of the outer casing where the wet steam enters, while the rest of said casing can be made of carbon steel to withstand the pressure to which it is subjected, since there is no danger of corrosion because it is only in contact with dry steam.

An embodiment of the invention is described by way of example with reference to the accompanying drawings in which.

Figure 1:
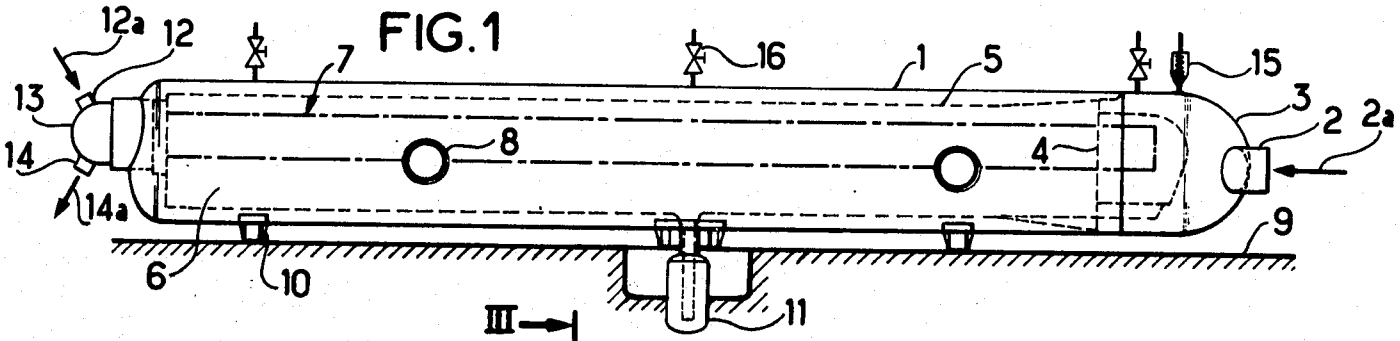
FIG. 1 is an elevation of a heat exchanger with two coaxial casings embodying the invention.

In FIG. 1, steam to be superheated enters an outer casing 1 of a superheating exchanger through two end openings 2 (see FIG. 3) in the direction of an arrow 2*a*. It comes initially into contact with an end portion 3 of said casing before entering an inner sleeve 5 through a perforated sheet 4.

The inner sleeve 5 contains a steam separator 6 in its lower part surmounted by a superheater 7 from which dry superheated steam emerges via two side pipes 8 fixed to the outer casing 1. The sleeve 5 and the end portion 3 of the outer casing 1 are made of stainless steel to prevent corrosion by the action of the water and steam emulsion for superheating with which they come into contact, while the remainder of the outer casing 1, with which the dry superheated steam also comes in contact but without having any undesirable effect thereon, is made of ordinary carbon steel.

The exchanger assembly is disposed horizontally on a floor 9 prepared for that purpose, on supports 10 disposed towards the ends of the outer casing 1.

A water draining system 11 is connected to the bottom of the outer casing 1 near its centre and collects the water which runs out of the separator 6.

The nest of tubes of the superheater 7 is supplied with heating steam via an inlet pipe 12 (in the direction of an arrow 12*a*) connected to the upper side of a hemispherical chamber 13 placed at the opposite end of the outer casing 1 to the openings 2. The condensates from the nest of tubes are removed from the lower side of the chamber 13 through an outlet pipe 14 (in the direction of an arrow 14*a*).

Lastly, the casing 1 is provided with known safety valves 15 and vents 16.

Figure 2:
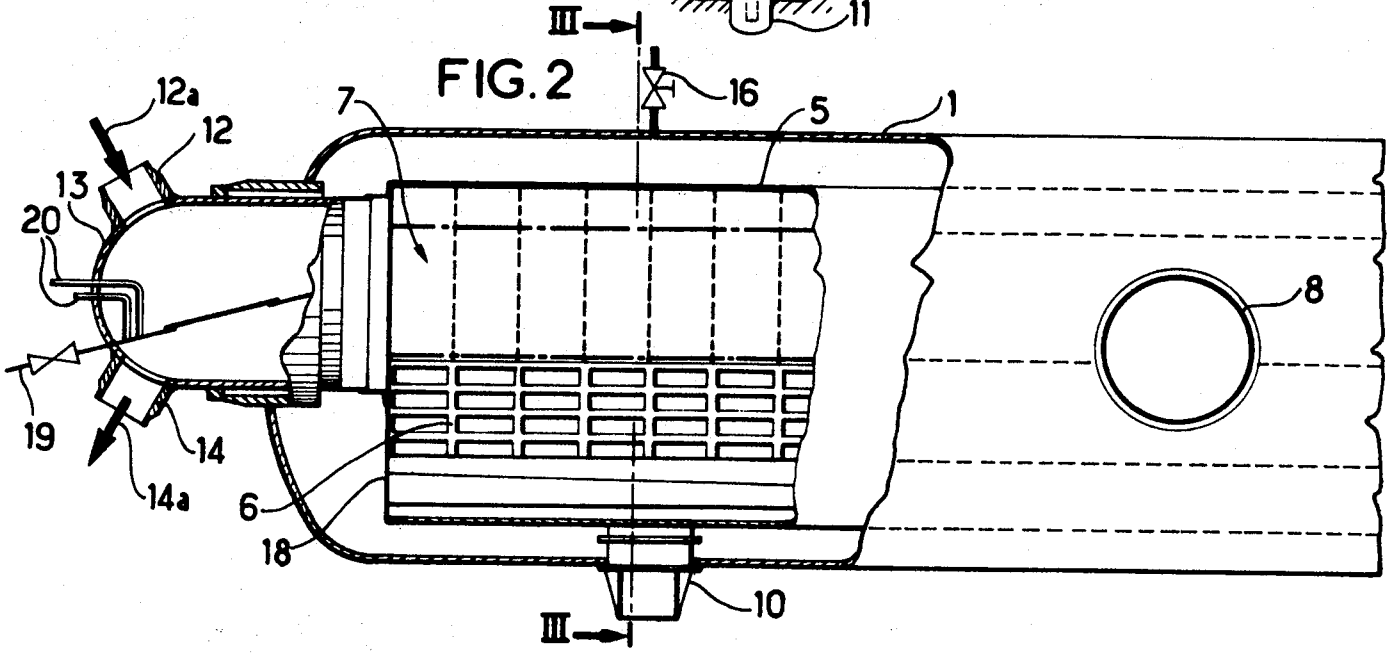
FIG. 2 is an enlarged cutaway view of the heating steam inlet side portion of FIG. 1.
Figure 3:
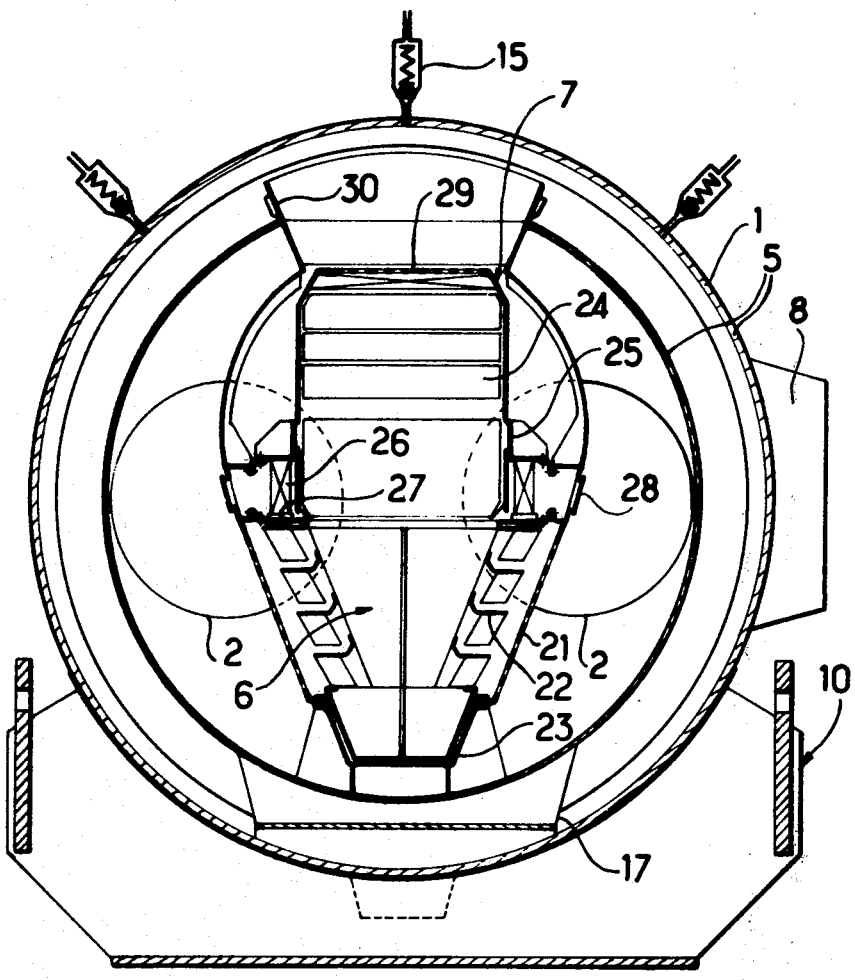
FIG. 3 is a transversal cross-section along the vertical plane III — III of FIG. 2.

In FIGS. 2 and 3 it can be seen that the inner sleeve 5 is connected to the outer casing 1 at the end for inlet of steam to be superheated by a fitting 17. The circle in FIG. 3 represents the periphery of the perforated sheet 4 which distributes the steam to be superheated within the inner sleeve 5. The other end of the inner sleeve 5 is closed by a metal sheet 18 to which the chamber 13 with a hemispherical end is fitted. This chamber, which supplies the superheater 7 with heating steam also includes known draining means and bleeding and balancing circuits.

The operation of the exchanger is as follows: the steam to be superheated enters the outer casing 1 through the openings 2, fills the sleeve 5 by passing through the perforated sheet 4, and enters baffle elements 22 of the separator 6 through perforated sheets 21.

The water which is stopped by the separator baffles is collected in drainage channels and flows down to a longitudinal collector channel 23 from which it flows to the draining system 11 (FIG. 1). Dry steam appears at the outlet of the separator 6, and comes into contact with the tubes in which the heating stem flows. These tubes are grouped together in superimposed nests 24 forming the separator assembly 7 installed in a metal structure 25 which rests on rollers 26 running in a track 27 allowing insertion support and free longitudinal expansion of the said nests while ports 28 provide the access necessary during the fixing in position of said nests.

At the outlet of the superheater 7 the superheated steam guided by an upwardly flared longitudinally extending opening 30 enters the space between the sleeve 5 and the casing 1 through perforated sheets 29 and emerges therefrom through the pipes 8 to the steam inlet of a turbine to be supplied, via the most direct and shortest path because of the lateral position of the pipe 8.

Another advantage of this disposition results from the fact that the outer casing is in contact only with the superheated steam at a constant temperature along almost all its length, this preventing any asymetrical horizontal deformation: such a defect resulting from differential expansion associated with the differences in temperature (giving the exchanger a banana shape) is to be avoided, in particular in nuclear power stations.

It is self-evident that this description in no way limits the scope of the invention and that changes known to the man in the art would still fall within the scope of the claims.

What is claimed is:

1. A device for drying and superheating steam and supplying it to a load, comprising: a cylindrical outer casing with a horizontal axis and a coaxial inner sleeve leaving an outer space in which flows superheated steam, the steam to be superheated flowing inside said inner sleeve, said inner sleeve including parallel to its axis:

(a) a separator with baffle plates for removing water from the emulsion of water and steam to be superheated in the lower part of said sleeve;

(b) nests of tubes comprising a superheater in the upper part of said sleeve; and (c) pipe means connecting said cylindrical outer casing to said load from at least one side opening of said cylindrical outer casing near said load; said outer casing being only in contact with dry superheated steam at a constant temperature along substantially its entire length for preventing corrosion and asymmetrical horizontal deformation.

2. A device according to claim 1, comprising at least one end opening for the inlet through said outer casing of the steam to be superheated.

3. A device as defined in claim 1 including at least one end opening for the inlet through said outer casing of the steam to be superheated; said exterior casing being made of carbon steel except for the inlet side for the steam to be superheated, said inlet side being made of stainless steel; said inner sleeve being made of stainless steel; perforated sheets located at the inlet for the wet steam into the separator; longitudinal elements arranged as baffle plates; a system for collecting water stopped in the separator and causing it to flow into a longitudinal collector channel; a pipe for connecting to a water draining system; the nest of said superheater tubes being detachable; said nest of tubes of the superheater being installed on a structure fitted with rollers resting on a longitudinal track allowing the nests to be inserted through an opposite end to that of the wet steam inlet, the inner sleeve being fitted with lateral ports providing access to the rollers and the track.

4. A heat exchanger according to claim 1, wherein the exterior casing is made of carbon steel except for the inlet side for the steam to be superheated, said inlet side being made of stainless steel.

5. A heat exchanger according to claim 1 wherein said inner sleeve is made of stainless steel.

6. A heat exchanger according to claim 1, comprising perforated sheets at the inlet for the wet steam into the separator, longitudinal elements arranged as baffle plates, a system for collecting water stopped in the separator and causing it to flow into a longitudinal collector channel, and a pipe for connection to a water draining system.

7. A heat exchanger according to claim 1, wherein the nests of superheater tubes are detachable.

8. A heat exchanger according to claim 7, wherein the nests of tubes of the superheater are installed on a structure fitted with rollers resting on a longitudinal track allowing the rests to be inserted through an opposite end to that of the wet steam inlet, the inner sleeve being fitted with lateral ports providing access to the rollers and the track.

* * * * *